US007063072B2

(12) United States Patent
Persson et al.

(10) Patent No.: US 7,063,072 B2
(45) Date of Patent: Jun. 20, 2006

(54) DIESEL ENGINE WITH CATALYTIC CONVERTER

(75) Inventors: Per Persson, Partille (SE); Jan Wiman, Västra Frölunda (SE); Jonas Rick, Linköping (SE)

(73) Assignee: Volvo Lastvagnar AB, Gothenburg (SE)

( * ) Notice: Subject to any disclaimer, the term of this patent is extended or adjusted under 35 U.S.C. 154(b) by 331 days.

(21) Appl. No.: 10/469,588

(22) PCT Filed: Feb. 28, 2002

(86) PCT No.: PCT/SE02/00355

§ 371 (c)(1),
(2), (4) Date: Jan. 9, 2004

(87) PCT Pub. No.: WO02/070889

PCT Pub. Date: Sep. 12, 2002

(65) Prior Publication Data

US 2004/0103649 A1 Jun. 3, 2004

(30) Foreign Application Priority Data

Mar. 2, 2001 (SE) ..... 0100719

(51) Int. Cl.
*F02M 33/00* (2006.01)
*F02N 3/00* (2006.01)

(52) U.S. Cl. ..... 123/446; 60/274

(58) Field of Classification Search ..... 60/274, 60/276; 123/446, 506

See application file for complete search history.

(56) References Cited

U.S. PATENT DOCUMENTS 4,452,040 A 6/1984 Kobashi
4,617,793 A 10/1986 Suzuki et al.

(Continued)

FOREIGN PATENT DOCUMENTS

EP 0974747 1/2000
WO WO 9922128 5/1999

OTHER PUBLICATIONS

Patent Abstracts of Japan, abstract of JP 5-156993 A (Hino Motors Ltd.) Jun. 22, 1993 , abstract.
Patent Astracts of Japan, abstract of JP 59-68512 A (Diesel Kiki K.K.), Apr. 18, 1984, abstract.

*Primary Examiner*—Thomas Moulis
(74) *Attorney, Agent, or Firm*—Young & Thompson

(57) ABSTRACT

Diesel engine with unit injectors and a catalytic converter arranged in the engine exhaust system, for reaction with uncombusted fuel. The injectors have spill valves, which in their closed position build up pressure in the injectors, and needle control valves, which in their closed position keep the needle valves of the injectors closed and which, when they are open, open the needle valves. The unit injectors have pump plungers, which are driven by individual cam elements whit a cam curve shaped so that a pressure is maintained in the injects for so long a period during one cycle that injection of fuel is permitted at least when an associated exhaust valve in the combustion chamber begins to open so late during the expansion stroke and temperature drop, that fuel after injection is not combusted in the cylinder but reaches the catalytic converted uncombusted.

17 Claims, 4 Drawing Sheets

U.S. PATENT DOCUMENTS 4,960,083 A * 10/1990 Seki et al. ..... 123/90.16
5,479,775 A * 1/1996 Kraemer et al. ..... 60/274
2002/0194837 A1* 12/2002 Fluga et al. ..... 60/284
2004/0096372 A1* 5/2004 Minami ..... 422/171
2004/0206068 A1* 10/2004 Michelini ..... 60/284
2005/0252198 A1* 11/2005 Okugawa et al. ..... 60/284

* cited by examiner

DIESEL ENGINE WITH CATALYTIC CONVERTER

The present invention relates to an internal combustion engine, comprising one or more cylinders with individual combustion chambers, a fuel injector opening into each combustion chamber, individual fuel pump means for each injector for feeding fuel to the respective injector, an exhaust conduit leading from the respective combustion chamber and opening into a device for post-treatment of exhaust, a cam shaft driven by the engine crankshaft with a cam element for one or more fuel pump means, said cam element having a cam curve shaped to provide, once per operating cycle, a pump stroke in the associated fuel pump means and an electronic control unit, arranged to control a spill valve and a needle control valve, coordinated with each injector, for controlling the injection amount and point in time during the respective pump stroke as a function of various control parameters fed into the control unit.

It is known to use so-called DENOX catalytic converters for catalytic reduction of nitric oxides in exhaust from diesel engines. It is also a known fact that such catalytic converters have a relatively low efficiency and a narrow temperature range within which they function and that it is possible to supply hydrocarbons to reduce $NO_x$. This can be accomplished for example by supplying extra diesel fuel in such a manner that it reaches the catalytic converter in a vapourized state. Where the fuel is supplied is of little importance as long as no combustion occurs prior to the catalytic converter.

Various methods and systems for supplying fuel to the catalytic converter are known. One method uses the ordinary engine injector to inject a small amount of fuel directly into one or more of the engine combustion chambers during the exhaust phase so that the fuel in uncombusted form is transported with the exhaust gases to the catalytic converter. In engines with a fuel system of the common rail type, the system is under constant high pressure and fuel can, in theory, be injected at any number of points in time at any time during the engine cycle. Injection control for the usual injection phase and for the extra post-injection phase is accomplished with the aid of a control unit which opens and closes the valves as a function of engine and vehicle data supplied to the control unit. With a common rail fuel system the post-injection phase can be freely selected, since the system has no varying fuel pressure cycle to consider, which is the case with the most common camshaft-driven fuel injection systems.

An arrangement for achieving post-injection in engines with camshaft-driven unit injectors is shown and described in SE-9700967-4. Here, the cam element of the respective injector is provided with a first cam lobe for the regular fuel injection during the engine compression phase and a second cam lobe for post-injection, a predetermined number of crankshaft degrees after the regular injection. The time interval for the second injection phase is determined by the geometric position of the second cam lobe relative to the first, while the exact moment of injection and the injection amount from each injector can be varied depending on the operating state of the engine, with the aid of the spill valve, which can also be used to determine whether injection shall be effected at all, i.e. the amount can be controlled to zero.

The purpose of the present invention is in an engine with camshaft-driven individual fuel pump means for each injector, to achieve an injection system which provides practically the same freedom as a common rail system as regards selection of the time of injection and the fuel amount for the post-injection phase.

This is achieved according to the invention in an engine of the type described by way of introduction, which is characterized in that the cam curve is shaped so that an opening pressure is maintained in the fuel injector so long during one cycle that fuel injection is permitted at least so late that a combustion does not occur in the cylinder, and that the control unit is arranged to control the spill valve and the needle control valve, so that at least a first amount of fuel can be injected during the compression stroke of the engine and, depending on said control parameters, at least one additional amount of fuel can be injected later and transported, in an uncombusted state, with the exhaust to the device for post-treatment of exhaust.

By utilizing a unit injector of a type which is known per se, which, in addition to the spill valve, also has a so-called needle control valve, and adapting the cam curve of the cam element in the manner defined, the point or points in time for post-injection during the exhaust phase can be selected freely as long as the built up pressure is sufficient to open the needle valve of the injector.

The invention will be described in more detail below with reference to examples shown in the accompanying drawings, where FIG. 1 shows schematically one half of a multi-cylinder straight engine;

Figure 1:
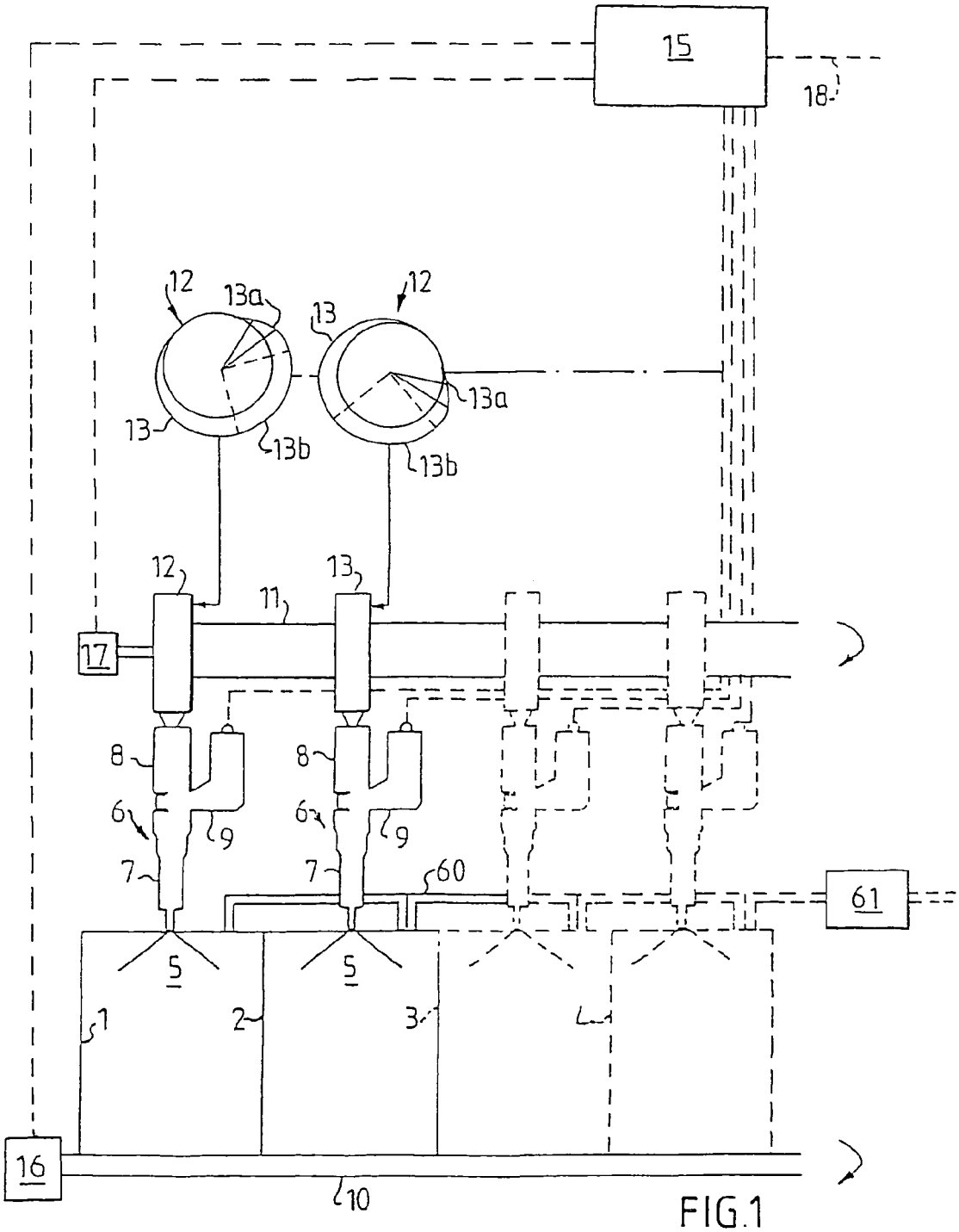
Figure 2:
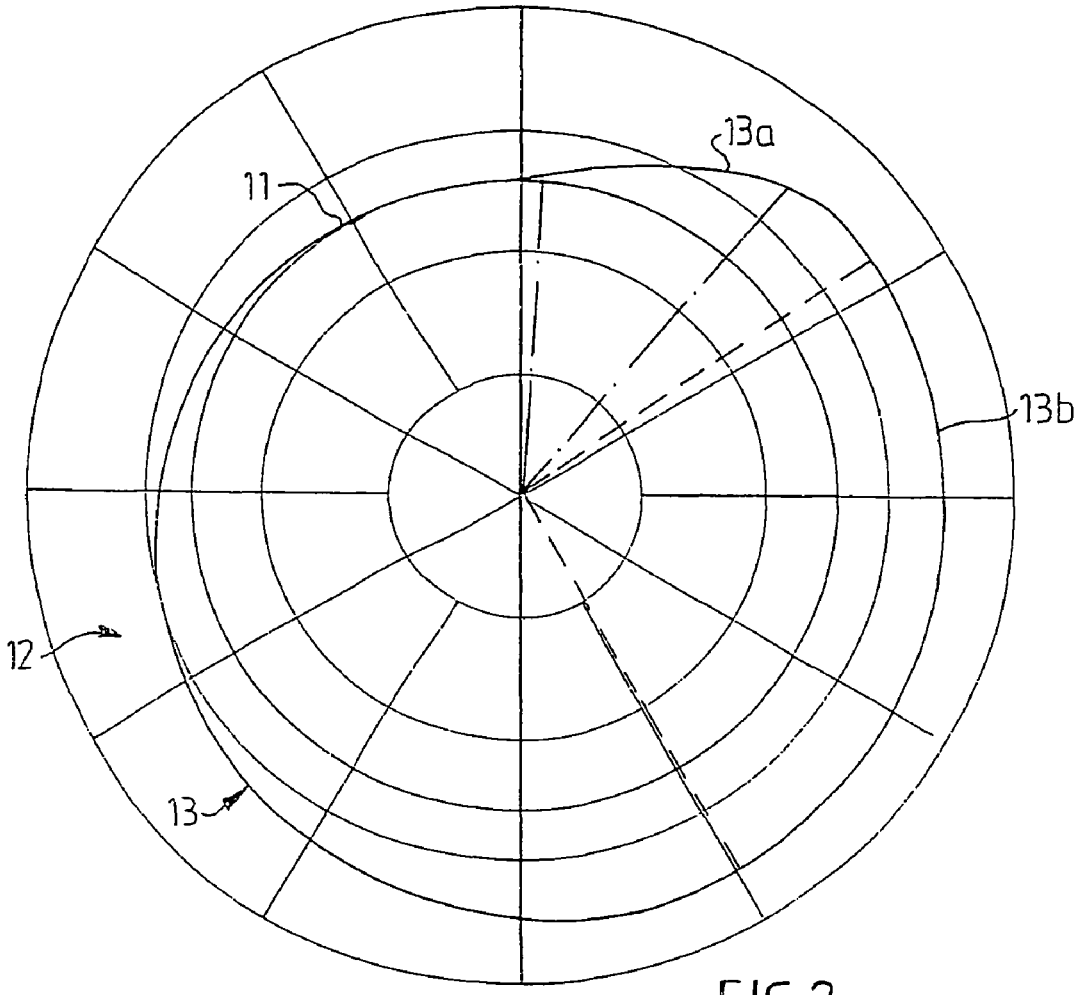
FIG. 2 shows an enlargement of the cam profiles in FIG. 1.

In FIG. 1, 1 and 2 designate two cylinders in a four-stroke diesel engine. Additional cylinders 3 and 4 are indicated with dashed lines. These can be the third and fourth cylinders in an engine with four and more cylinders.

Into the combustion chamber 5 of each cylinder, a fuel injector. (generally designated 6) opens. The fuel injector comprises an injector portion 7 and a pump portion 8 with associated electronically controlled spill and needle control valve 9. A fuel injector of this type is usually called an electronic unit injector, since the pump 8 and the injector 7 form a unit. The pump 8, which is shown in more detail in FIG. 4 together with the other components of the injector, is a plunger pump and the movement of the plunger is achieved in a known manner with the aid of a camshaft 11, driven by the engine crankshaft 10. The camshaft 11 has a cam element 12 for each injector.

All the cam elements 12 have identical cam profiles 13 (FIG. 2), which cause the pump stroke. The cam profiles 13 are phase relative to each other in accordance with the ignition sequence, and their shape determines the possible injection interval, while the actual injection times and fuel amounts are controlled by the spill and needle control valves 9, which are electromagnetically operated and controlled by an electronic control unit 15. Their functioning will be described in more detail below with reference to FIG. 4.

A sensor 16 and a sensor 17 provide signals to the control unit 15, representing the r.p.m. of the crankshaft 10 and the angle of the camshaft 11. Furthermore, signals are fed to the control unit representing the amount of fuel requested by the driver, e.g. accelerator pedal position 18. Further sensors coupled to the control unit, irrelevant to illustrating the invention, have been left out.

Figure 3:
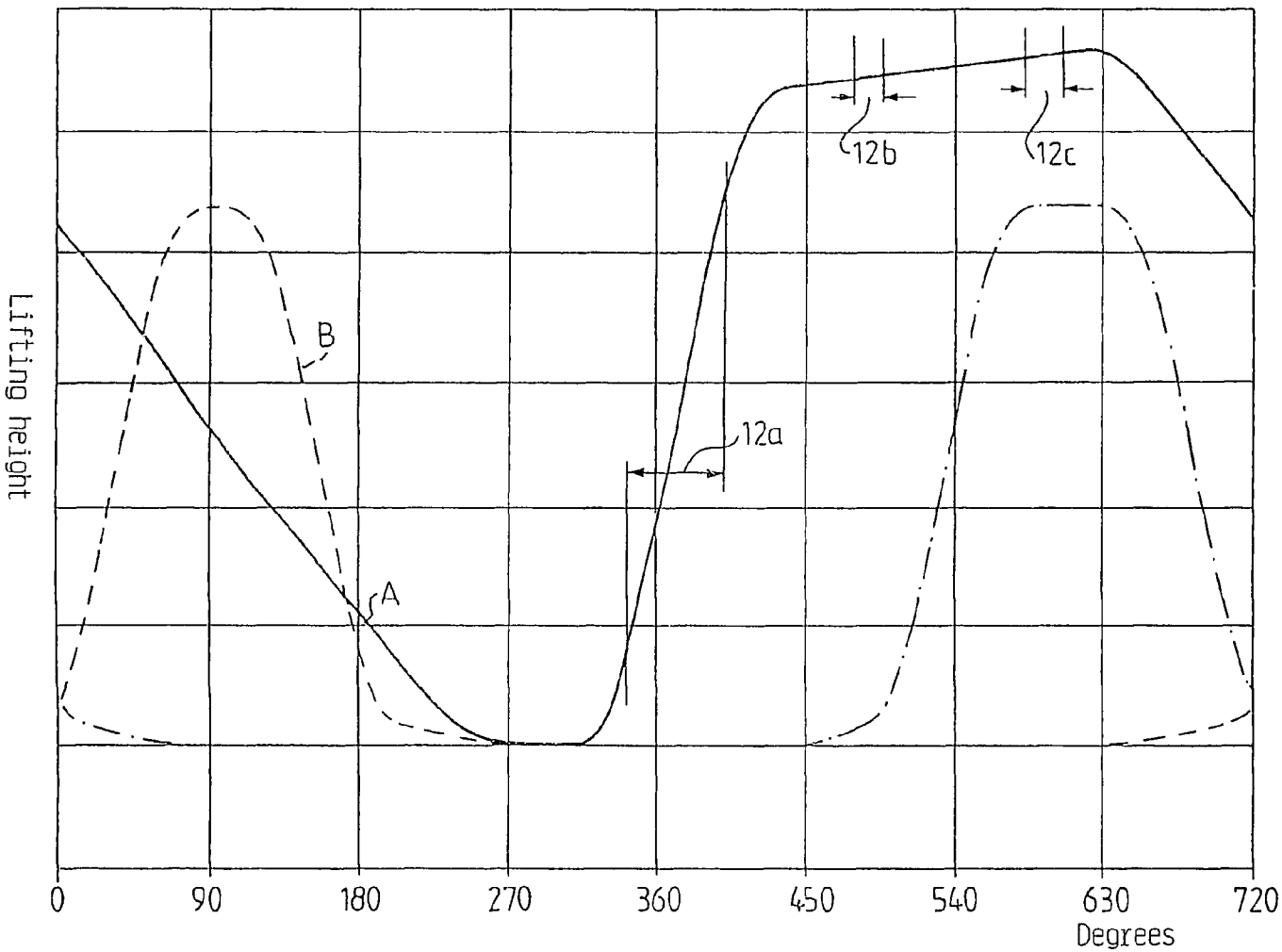
FIG. 3 shows a diagram of the lift curve of the fuel injection pump for the cam profile shown together with the lift curves of the intake and exhaust valves.

With the cam profile 13 shown in FIG. 2 there is obtained the lift curve, labelled A in FIG. 3, of the fuel pump plunger 30 (FIG. 4) of the injectors 6, the lift curves B and C, respectively, of the intake valve and the exhaust valve, respectively, are also drawn in. As can be seen in the diagram in FIG. 3, the cam profile shown provides a pump stroke which is initiated towards the end of the compression stroke at circa 320 crankshaft degrees. The pump plunger 30 first moves rapidly up to circa 450 crankshaft degrees to thereafter be retarded until it starts its return stroke at circa 630 crankshaft degrees at the same time as the exhaust valve begins to close. 13*a* in FIG. 2 designates the cam segment which presses against the plunger 30 during the ordinary fuel injection, when combustion is desired, while 13*b* designates the cam segment which presses against the plunger to maintain pressure for post-injection, when combustion should not occur. Rather, the fuel is to be oxidized downstream in the engine exhaust system.

Figure 4:
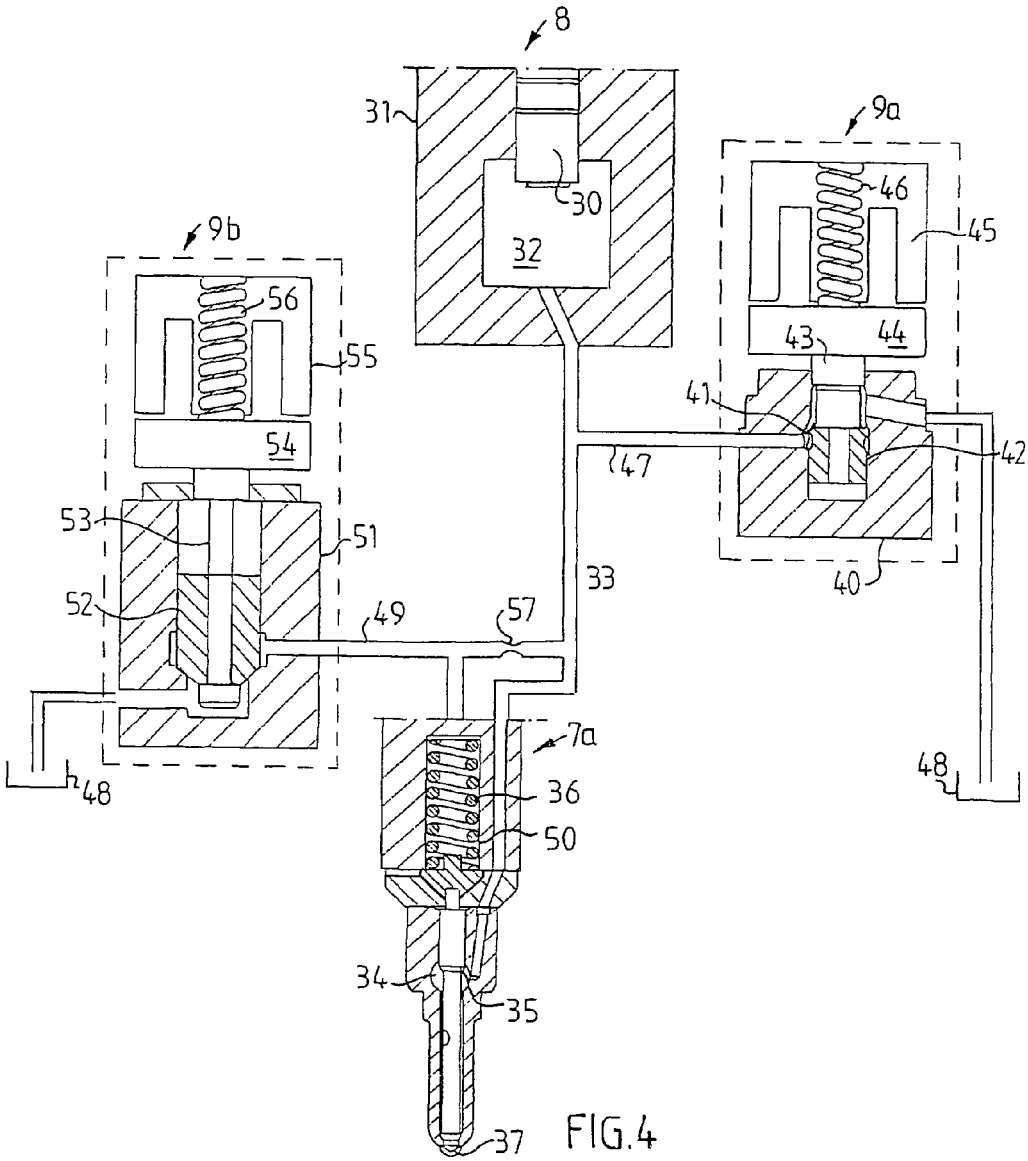
FIG. 4 shows schematically a unit injector with associated spill and needle control valves.

FIG. 4 shows the engine injectors schematically. The spill and needle control valve 9 is illustrated here for the sake of illustration as two separate valves, where 9*a* generally designates the spill valve and 9*b* designates the needle control valve. 7*a* designates the needle valve portion of the injector 7. The pump portion 8 has a housing 31 with a pump chamber 32, in which the previously mentioned pump plunger 30 can reciprocate with the aid of a cam element 12 for the pump stroke and a spring device (not shown) for the return stroke. The pump chamber 32 communicates via a channel 33 with a chamber 34 in the needle valve housing, in which a valve needle 35 is displaceably mounted and spring-biased by a spring 36 towards a position in which the needle closes the atomizer hole 37 of the injector. The needle 35 and the chamber 34 are made so that pressure in the chamber 34 loads the needle upwards in the figure, i.e. in the opening direction.

The spill valve 9*a* has a housing 40 with a valve chamber 41, containing a valve body 42, which is joined via a spindle 43 to an armature 44 of an electromagnet 45. The armature 44 is loaded by a spring 46 towards a position in which the valve body 42 is in its open position, so that a channel 47 from the channel 33 via the spill valve communicates with a return tank 48. When the electromagnet 45 is magnetized in response to a signal from the control unit 15, the armature 44 is pulled upwards in the figure and the valve body 42 shuts off the communication between the channel 33 and the tank 48. Pressure is then built up in the chamber 34, loading the valve needle 35 upwards in its opening direction. Via a channel 49 branched from the channel 33, the fuel is also led to the space 50, containing the return spring 36 of the valve needle 35, so that a pressure is built up which balances the pressure in the opening direction, if the needle control valve 9*b* communicating with the channel 49 is closed. The needle valve will then remain closed.

The needle control valve 9*b* has a housing 51 with a valve body 52, which is joined, via a spindle 53, to an armature 54 of an electromagnet 55. The armature 54 is biased by a spring 56 towards a position in which the valve body 52 closes off communication between the channel 49 and the return tank 48. When the electromagnet 55 is magnetized in response to a signal from the control unit 15 the armature 54 is pulled upwards in the figure and the valve body 52 opens the communication between the channel 49 and the tank 48. In the channel 49 prior to the needle valve 7*a*, there is a constriction 57, which means that when the needle control valve 9*b* opens at the same time as the spill valve 9*a* is closed in its position, the pressure above the valve needle 35 will drop relative to the pressure in the chamber 34 so that the needle valve will open.

With the spill valve 9*a* closed, pressure is built up in the injector 6 during the pump stroke, but in contrast to a conventional unit injector which only has a spill valve, and a needle valve of which opens when a predetermined pressure has been built up, the needle valve 7*a* will be held closed regardless of the pressure built up and refill only open when the needle control valve 9*b* opens. Theoretically, the needle valve 7*a* can be opened an unlimited number of times at any selected points in time and inject freely selected amounts of fuel during the pump stroke. In the diagram of FIG. 3, 12*a* designates the opening period of the needle control valve 9*b*, causing opening of the injector valve needle 35 for injecting fuel into the combustion chamber during the end of the compression stroke and the beginning of the expansion stroke. 12*b* and 12*c* designate two short post-injection periods, one after the other, during the exhaust phase. The points in time of the injections are selected so that the fuel is vapourized but not ignited in the cylinder, which means that vapourized fuel will be transported with the exhaust through the exhaust manifold 60 to a catalytic converter 61.

The control unit 15 is here arranged to control the spill valve 9*a* and the needle control valve 9*b* so that one or more additional amounts of fuel will be injected into the engine combustion chamber after the first ordinary fuel injection, when signals sent to the control unit 15 representing at least engine r.p.m. and first fuel amount requested by the driver, e.g. accelerator pedal position, indicate low engine load with accompanying relatively low exhaust temperature, when certain post-treatment systems, e.g. DPF (Diesel Particular Filter) or SCR (Selective Cataleptic Reduction) require supplementary energy to increase the temperature in the post-treatment system. Other systems, such as $DeNO_x$ or $NO_x$ trap can require additional uncombusted fuel in the exhaust, also at high engine load.

The invention has been described above with reference to an embodiment of a multi-cylinder engine with so-called unit injectors, but it can also be utilized in a single cylinder engine and an engine with so-called unit pump injectors, i.e. an engine with a fuel system, where the injectors and the pump device are separate but where each injector has its own pump plunger driven by a cam element. Theoretically, as a pump there can be used a straight pump, a radial plunger pump or an axial plunger pump.

The invention claimed is:

1. Internal combustion engine, comprising one or more cylinders with individual combustion chambers, a fuel injector opening into each combustion chamber, individual fuel pump means for each injector for feeding fuel to the respective injector, an exhaust conduit leading from the respective combustion chamber and opening into a device for post-treatment of exhaust, a cam shaft driven by the engine crankshaft with a cam element for one or more fuel pump means, said cam element having a cam curve shaped to provide, once per operating cycle, a pump stroke in the associated fuel pump means and an electronic control unit, arranged to control a spill valve and a needle control valve, coordinated with each injector, for controlling the injection amount and point in time during the respective pump stroke as a function of various control parameters fed into the control unit, characterized in that the cam curve (13) is shaped so that an opening pressure is maintained in the fuel injector (6) for so long during one cycle that fuel injection is permitted at least so late that combustion does not occur in the cylinder, and that the control unit (15) is arranged to control the spill valve (9*a*) and the needle control valve (9*b*), so that at least a first amount of fuel can be injected during the compression stroke of the engine and, depending on said control parameters, at least one additional amount of fuel can be injected later and be transported, in an uncombusted state, with the exhaust to the device (61) for post-treatment of exhaust.

2. Internal combustion engine according to claim 1, characterized in that the cam curve (13) is shaped so that the pump stroke lasts at least until an associated exhaust valve in the combustion chamber is completely open.

3. Internal combustion engine according to claim 1, characterized in that the control unit (15) is arranged to control the spill valve 9*a* and the needle control valve 9*b*, so that the additional amount of fuel is injected before the exhaust valve is completely open.

4. Internal combustion engine according to claim 1, characterized in that the control unit (15) is arranged to control the spill valve (9*a*) and the needle control valve (9*b*), so that an additional amount of fuel is injected when signals sent to the control unit, representing at least engine r. p. m. and a driver-requested first amount of fuel, indicate low engine load.

5. Internal combustion engine according to claim 1, characterized in that the cam curve (13) is shaped so that the pump stroke begins before the piston in the associated cylinder chamber reaches upper dead center during the compression stroke and lasts until the exhaust valve is completely open.

6. Internal combustion engine according to claim 5, characterized in that the cam curve (13) is shaped so that the return stroke begins when the exhaust valve begins to close.

7. Internal combustion engine according to claim 1, characterized in that each injector (6) with associated fuel pump means (8), spill valve (9*a*) and needle control valve (9*b*) forms an integrated unit in the engine cylinder head, a so-called unit injector.

8. Internal combustion engine according to claim 1, characterized in that each injector communicates with a fuel pump means which is separated from the injector.

9. Internal combustion engine according to claim 2, characterized in that the control unit (15) is arranged to control the spill valve 9*a* and the needle control valve 9*b*, so that the additional amount of fuel is injected before the exhaust valve is completely open.

10. Internal combustion engine according to claim 2, characterized in that the control unit (15) is arranged to control the spill valve (9*a*) and the needle control valve (9*b*), so that an additional amount of fuel is injected when signals sent to the control unit, representing at least engine r. p. m. and a driver-requested first amount of fuel, indicate low engine load.

11. Internal combustion engine according to claim 3, characterized in that the control unit (15) is arranged to control the spill valve (9*a*) and the needle control valve (9*b*), so that an additional amount of fuel is injected when signals sent to the control unit, representing at least engine r. p. m. and a driver-requested first amount of fuel, indicate low engine load.

12. Internal combustion engine according to claim 2, characterized in that the cam curve (13) is shaped so that the pump stroke begins before the piston in the associated cylinder chamber reaches upper dead center during the compression stroke and lasts until the exhaust valve is completely open.

13. Internal combustion engine according to claim 3, characterized in that the cam curve (13) is shaped so that the pump stroke begins before the piston in the associated cylinder chamber reaches upper dead center during the compression stroke and lasts until the exhaust valve is completely open.

14. Internal combustion engine according to claim 4, characterized in that the cam curve (13) is shaped so that the pump stroke begins before the piston in the associated cylinder chamber reaches upper dead center during the compression stroke and lasts until the exhaust valve is completely open.

15. Internal combustion engine according to claim 12, characterized in that the cam curve (13) is shaped so that the return stroke begins when the exhaust valve begins to close.

16. Internal combustion engine according to claim 13, characterized in that the cam curve (13) is shaped so that the return stroke begins when the exhaust valve begins to close.

17. Internal combustion engine according to claim 14, characterized in that the cam curve (13) is shaped so that the return stroke begins when the exhaust valve begins to close.

* * * * *